United States Patent [19]

Phillips, Jr.

[11] 3,935,668

[45] Feb. 3, 1976

[54] NON CIRCULAR HOOP

[76] Inventor: James T. Phillips, Jr., 4336 W. 59th Place, Los Angeles, Calif. 90043

[22] Filed: Nov. 29, 1974

[21] Appl. No.: 528,352

[52] U.S. Cl. ..... 46/220; 273/106 B

[51] Int. Cl.[2] ..... A63H 33/02

[58] Field of Search ..... 46/220, 114, 47, 51, 221, 46/211; 273/106 B, 126 R, 58 K; 217/91; 63/3, 15.7

[56] References Cited

UNITED STATES PATENTS

| | | | |
|---|---|---|---|
| 2,694,574 | 11/1954 | Baker | 273/58 K |
| 2,984,937 | 5/1961 | Rendon | 46/220 |
| 3,201,897 | 8/1965 | Balthazor | 46/221 |

FOREIGN PATENTS OR APPLICATIONS

| | | | |
|---|---|---|---|
| 22,792 | 2/1962 | Germany | 46/220 |

*Primary Examiner*—Louis G. Mancene
*Assistant Examiner*—Jack Q. Lever
*Attorney, Agent, or Firm*—Victor C. Muller

[57] ABSTRACT

Hoop for propelling along a surface with a trundle, characterized by being formed of interchangeable sections to vary its circular diameter and at least one section for rendering it non-circular to effect erratic rolling.

10 Claims, 10 Drawing Figures

NON CIRCULAR HOOP

BACKGROUND OF THE INVENTION

In the sport or amusement of rolling hoops along the ground, particularly by children, many trundles have been devised to aid in the control of same, exemplary of which are those disclosed in my U.S. Pat. No. 3,827,180, prior art cited therein, and many others. While the various trundles have reached a high degree of perfection in the control of movement of a hoop, which is desirable for beginners in the sport, this desirability can be disadvantageous to those who have mastered their use in that what was originally a challenge to one's skill becomes monotonous and thus causes loss of interest and premature abandonment of the sport. Part of this is probably due to the design of the prior art hoops which have been constructed in substantially true circular form which rotate about the geometric center of a circle and which thus have a predictable stability, rotational velocity and direction of movement. As an example of the foregoing, the trundle operator may walk or run behind the hoop at constant velocity and the hoop rolls along the ground at constant forward velocity while rotating about its center at constant angular velocity, the only controls necessary being to change its direction of movement when desired or necessary or to accelerate or arrest its motion, which latter involves only a change of speed of the operator. Thus, while the operator may move at desired constant speed, may accelerate or decelerate to a new speed, these changes result only due to his desire rather than being compelled to do so by reason of the hoop design. As will be apparent, if the hoop design compelled the operator to make periodic changes in his velocity, a new skill, not heretofore required with a circular hoop, would be required.

Another disadvantage of the prior art resides in the nonadjustability of the diameter of circular hoops. The skill required to propel a hoop varies with its diameter, hence, an operator must procure a number of hoops of various fixed diameters if he desires to test his skill with hoops of different sizes.

SUMMARY OF THE INVENTION

The present invention, in one aspect, provides a hoop formed of a plurality of segments which may be assembled, by choice of the number of segments, to form circular hoops of various diameters. Thus, the beginner may assemble, say two sections, to form a relatively small hoop and, as he develops skill, add further sections to progressively increase the diameter to other larger diameters. After he has mastered the use of circular hoops of various diameters he may assemble the hoop to include a non-circular segment which produces erratic rotation, thus requiring the further development of skill. As with the circular hoops, the non-circular hoops may be formed in various sizes to progressively require the development of further skill.

In accordance with the foregoing, one of the objects of the invention is to provide a hoop formed in segments of flexible material which, by choice of the number of segments employed, may be assembled into circular hoops of various diameters.

Another object is to provide a non-circular segment which may be assembled with other segments to provide non-circular hoops of various sizes.

Another object is to provide hoops in accordance with the preceeding objects which may be used for rolling along a surface with a propelling trundle.

Another object is to provide hoop segments which may be detached from each other to reduce overall dimensions for facilitating shipping, handling and transportation of the hoop.

Another object is to provide a detachable joint between segments which is simple in construction and economical of manufacture to thereby provide a hoop which may be marketed at nominal cost and within the monetary means of most users.

A further object is to provide segments of different colors which add interest to the user and also produce varying colored effects to an observer when the hoop is in motion.

Still further objects, advantages and salient features will become more apparent from the detailed description to follow, the appended claims, and the accompanying drawing to now be briefly described.

DETAILED DESCRIPTION OF PREFERRED EMBODIMENTS

Figure 4:
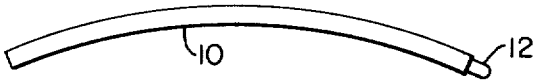
FIG. 4 is a side elevation of a segment employed in other FIGS.
Figure 2:
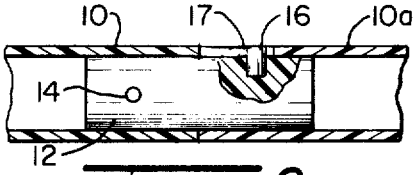
FIG. 2 is an enlarged section taken on line 2—2, FIGS. 1 and 5.

Referring now to the drawing, and first to FIG. 4; segment 10 is formed of flexible plastic tubing which may be straight or curved to circular shape. As best shown in FIG. 2, a dowel 12 is secured in one end of same by a pin 14, cement, or a heat seal, its projecting end telescoping within the adjacent segment 10*a*, preferably with a tight friction fit. To maintain the segments in planar relation a pin 16 may be provided on dowel 12 which registers in slot 17 in the end of segment 10*a*. As will be apparent, the unshown end of segment 10*a*, FIG. 2, will also be provided with a like dowel 12. Thus, all segments are interchangeably detachably connected together by like dowels and register to maintain all segments in a single plane.

Figure 5:
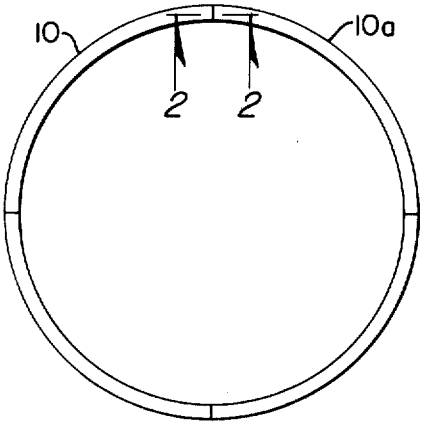
FIG. 5 is a side elevation of a circular hoop formed from four segments of FIG. 4.
Figure 6:
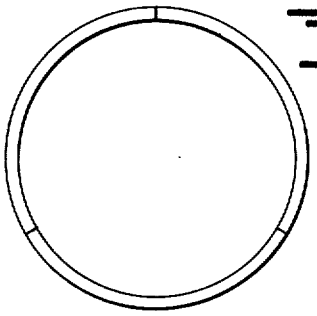
FIG. 6 is a like elevation formed of three segments of FIG. 4.
Figure 7:
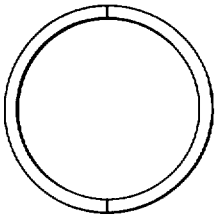
FIG. 7 is a like elevation formed of two segments of FIG. 4.

FIGS. 5, 6 and 7 illustrate respectively, hoops formed of 4, 3 and 2 of segments 10 which provide circular hoops of various diameters. As will be apparent, the segments bend uniformly along their lengths whereby the original segments of FIG. 4 conform to circular shapes of smaller radii when the sections are assembled. Usually the beginner will first develop his skill rolling one of the hoops, then advance to others which are more difficult to roll. While only four segments are illustrated in FIG. 5, it will be apparent that more segments may be employed to form larger hoops of any desired diameters.

Figure 1:
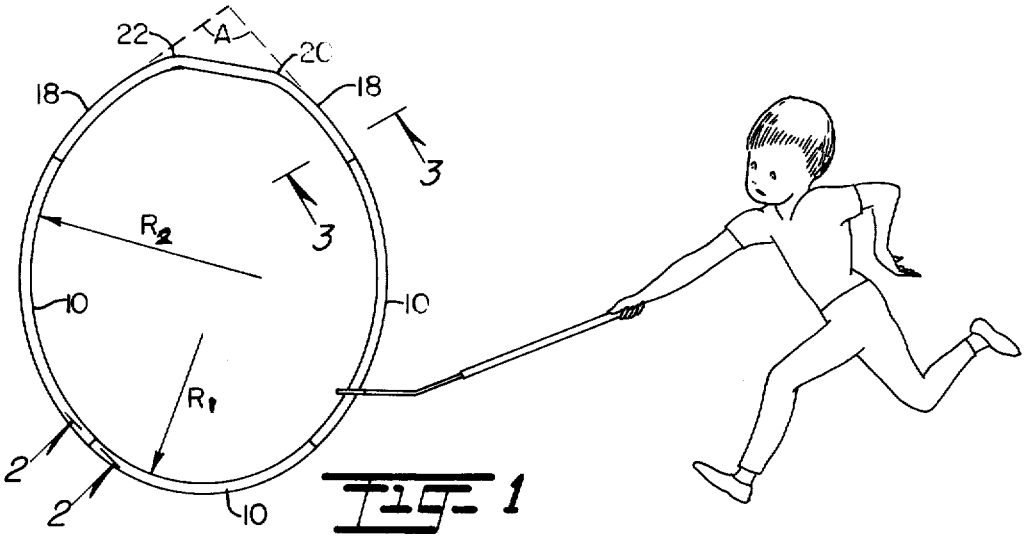
FIG. 1 is a side elevation of a segmental non-circular hoop.

Assuming, now, that the operator has mastered the rolling of circular hoops, he may advance to the non-circular hoop in FIG. 1. As illustrated, this is formed by three of the segments of FIG. 4 and an uppermost segment 18 which is non-circular. Preferably, considerable transitions of curvature are provided to form bumps or knuckles 20,22 which render the rolling somewhat erratic. Bump or knuckle 20, for example, could be defined as the juncture between portions at each side thereof which are angularly related. Assuming that such portions are flat then their centers of curvature would be on lines normal thereto at infinity. Assuming that the portions have large radii of curvature this would place their centers of curvature short of infinity but still spaced considerably apart. This thus distinguishes from adjacent portions of a circle wherein the radii of curvature of such portions are coincident, that is at the center of the circle. As will be apparent the same definition applies to bump or knuckle 22. Also, as illustrated, the lowermost segment bends to a generally uniform radius R, but left and right segments thereabove do not. These segments increase in radius of curvature so that at their upper ends radius $R_2$ is greater than radius $R_1$. The lower segment and the right and left segments thereabove are thus somewhat egg-shaped. This egg-shape continues into upper segment 18 to the knuckle points 20,22 where the egg shape changes to a substantial flat portion at the top of segment 18.

As distinguished from a circular hoop wherein the center of rotation is a constant distance from the surface on which it rolls, the instantaneous center of rotation of the non-circular hoop is constantly changing and is disposed at varying distances from the surface on which it is rolled. The instantaneous center of rotation thus moves in a curved path as distinguished from a straight line in the circular hoop. Since the center of mass is thus also changing relative to a surface on which it rolls, the hoop tends to speed up and slow down during portions of its revolution which compels the operator to develop skill in maintaining its rolling motion stable. Due to the erratic motion of the hoop it is preferred that a closed loop trundle, such as disclosed in my patent referred to, be employed so that the hoop is captured within the trundle loop.

Typical dimensions for the segment of FIG. 4 is about 32" arcuate length which provides hoops of about 40", 30", and 20" diameters, respectively, in FIGS. 5, 6 and 7. Tubing may be about 5/8" I.D. and ¾" O.D.

Figure 3:
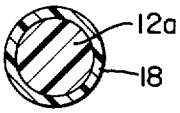
FIG. 3 is an enlarged section taken on lines 3—3, FIG. 1, illustrating a rod within the uppermost segment.

FIG. 3 illustrates a slight modification of the FIG. 1 construction. As illustrated, dowel 12 is elongated as a polyethylene rod 12a which extends the major length of segment 18, FIG. 1. This adds weight to segment 18 and, being an eccentric weight, further unbalances the hoop so that the hoop further tends to slow down as segment 18 rises from the surface and tends to speed up as it descends toward the surface, thus effecting further erratic angular velocity about its instantaneous centers of rotation. Also, the rod renders segment 18 more rigid against bending than without same.

The angle A between the outer ends of segment 18 may be chosen to vary the egg-shape of the hoop. As this angle is increased the hoop becomes less egg shaped and as it is decreased the major axis increases and renders it more egg shaped.

It will be apparent that with four segments 10 of FIG. 4, three different diameter circular hoops may be formed as illustrated in FIGS. 5, 6 and 7. With the addition of one non-circular segment 18, one to four of segments 10 may be employed to form four different non-circular hoops, or a total of seven different hoops. As will also be apparent, the number of sections of each type may be varied as desired. For example, by the addition of another non-circular segment 18 of the shape illustrated or varying therefrom, the noncircular hoop may be provided with further knuckles spaced about the periphery and, by choice of spacing of the noncircular segments and choice of number of segments 10 employed, the number of combinations may be further increased. FIG. 1 is thus only exemplary of many forms of non-circular hoops contemplated within the purview of the invention. The modulus of the tubing employed should be low so that it may readily be bent during assembly but its yield point should be high so that it may be bent to many different diameters and yet return to its relaxed state when the segments are disconnected. As will further be apparent, when the sections are disconnected they occupy only a small space which facilitates shipping or transportation thereof. While less desirable from a transportation point of view, the non-circular hoop of FIG. 1 may be formed of a single length of tubing of any desired length with joined ends and formed to desired shape, such as by application of heat thereto.

Figures 8A, 8B, 8C:
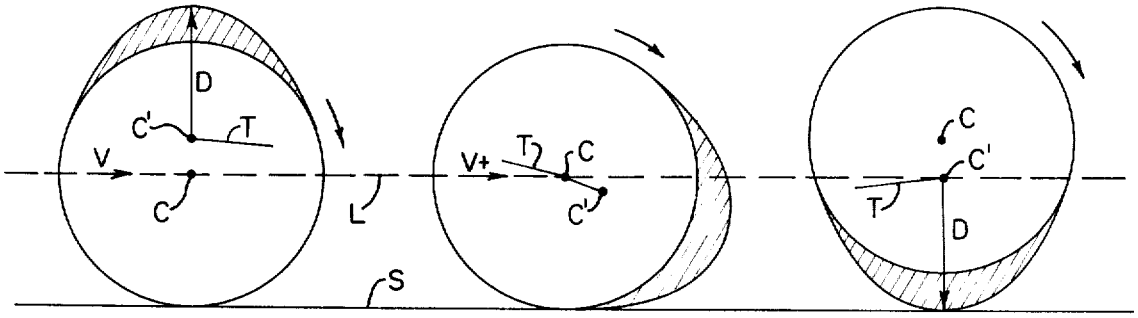
FIG. 8A, 8B, 8C illustrate successive positions of a non-circular rolling body.

FIGS. 8A, 8B, 8C illustrate a comparison between a circular disc or hoop of uniform cross section rolling along a horizontal surface S and a non-circular disc or hoop rolling along same, the latter being illustrated by the shaded portion added to the circle. It will be assumed that there is no rolling friction, no air drag and the body has a velocity V in FIG. 8A. Taking, first, the circular body, it is apparent that its centroid C is at its geometric center and will move along a straight dotted line L, parallel with surface S. Under the assumptions, above, its linear velocity will remain constant. Taking, now, the non-circular body, it is apparent that its centroid C' is somewhat above C in FIG. 8A due to the added shaded mass. As the body rolls from FIG. 8A to FIG. 8B centroid C' falls along curved path T. Since this represents work which must go into the system it is apparent that the original velocity V must increase to satisfy the law of conservation of energy, the velocity now being maximum. As the body rolls from FIG. 8B to FIG. 8C it rolls onto the top of the shaded lobe and, since centroid C' is a fixed distance D from the peak of the lobe, it must rise to the position shown in FIG. 8C. This rise of the centroid, however, must subtract work from the system hence its velocity must decrease. As the body rolls to the other point of tangency with the lobe (complimentary to FIG. 8B), the centroid C' drops and the velocity increases to the same value as in the position of FIG. 8B. The centroid C' must next rise to its position of FIG. 8A during which the body loses velocity until it is the same velocity V when it reaches the original position of FIG. 8A. Thus, in the first half revolution, the body accellerates until the lobe engages the surface, then decelerates, then accelerates temporarily during the second half of the revolution and next decellerates to its original velocity V. As will be understood, in actual practice the body would continually lose some of its original velocity and momentum due to rolling friction and air drag. Regardless of this, however, the body still has periods of acceleration and deceleration.

The periods of change of velocity can produce two different effects on the operator. Assume, first, that the operator is propelling the hoop with a u-shaped trundle which does not capture the hoop and he is moving at constant velocity. Since there are periods of acceleration and deceleration it will be apparent that at times the trundle will slow down the hoop forward velocity and other times when the hoop will tend to roll ahead of its engagement with the trundle. This thus means that if the input propelling energy is to balance the friction losses, the operator must accelerate and decelerate periodically. While this mode of propelling is feasible with a highly skilled operator, it will normally be found too difficult for children. It is preferred, accordingly that a closed loop trundle, such as disclosed in my patent referred to, be employed so that the hoop remains captured to the trundle. With such type of trundle and with the operator moving at constant velocity, the hoop still tends to accelerate and decelerate but is constrained to move at the constant velocity of the operator. There are thus periods when the rear bight of the trundle is applying a propelling force to the hoop and other times when the forward bight is braking the tendency for the hoop to accelerate. When the operator has developed sufficient skill to maintain the non-circular hoop rolling along a desired course with a hoop-captured propelling and braking trundle he may, of course, further develop his skill with an open or u-shaped type trundle with which only a propelling force may be applied. This, of course, will test his ultimate skill.

What I claim is:

1. In a hoop of the type adapted to be rolled along a surface with a propelling trundle comprising;

a. a plurality of first segments and at least one second segment adapted to be interchangeably assembled in various combinations to form hoops of various sizes and various shapes, b. the first segments being formed of flexible material of uniform cross section, such as plastic tubing, c. the second segment being formed of like material of like cross section and having a knuckle thereon formed at the juncture of angularly related portions having centers of curvature which are considerably spaced apart, said knuckle adapted to disturb the rolling action of the hoop as it rolls across same from one of the adjacent portions to the other adjacent portion, d. means for detachably connecting an end of any segment with an end of any other segment, e. the first segments being sufficiently flexible to bend to various radii of curvature, f. the construction and arrangement being such that:

g. when at least two of the first segments are secured together they form a substantially circular hoop, and h. when at least one of the first segments and at least one of the second segments are secured together they form a hoop having said knuckle thereon.

2. A hoop in accordance with claim 1 wherein the second segment is provided with ends so angularly related to distort an adjacent first segment or segments from relaxed radii of curvature to radii of curvature which increases in directions toward the juncture thereof with the second segment whereby the hoop is generally egg-shaped with the knuckle disposed at the small end of the egg-shape.

3. A hoop in accordance with claim 2 including a second knuckle on the second segment adapted to effect a second disturbance in the rolling action of the hoop as it rolls across same.

4. A hoop in accordance with claim 3 wherein the two knuckles effect differing disturbances in the rolling action of the hoop as it rolls across same.

5. A hoop in accordance with claim 1 wherein the detachable connecting means comprises a flexible pin fixedly secured within an end of each segment and extending therebeyond, the extending portion adapted to frictionally fit within an end of an adjacent segment.

6. A hoop in accordance with claim 5 including means for maintaining adjacent segments in registry so that they lie in a common plane.

7. A hoop in accordance with claim 1 wherein the second segment is a circular plastic tube and contains a circular plastic rod extending substantially throughout the length thereof, the rod adding rigidity to the segment against bending and also providing added weight to further unbalance the hoop, one end of the rod extending beyond one end of the segment to provide a dowel for connecting same to an adjacent segment.

8. In a hoop of the type to be rolled along its periphery on a flat surface and propelled by a trundle carried in the hand of an operator moving therebehind, comprising;

a. the hoop being formed of material of uniform cross section formed into a closed planar loop of non-circular shape, with its centroid disposed at variable radial distances from at least portions of its periphery, b. said centroid being moveable in a curved path when the hoop is rolling along said surface to effect a rise and fall of the centroid relative to said surface, the falling of the centroid tending to accelerate the forward motion of the rolling hoop and the rising of the centroid tending to decelerate the forward motion of the rolling hoop, c. the non-circular shape and acceleration and deceleration being sufficiently substantial to render it too difficult to propel by children with a trundle of the type which does not capture the hoop, and d. a trundle of the type having a propelling end of the type constructed to encircle and capture the hoop, to enable an operator to move behind the hoop at constant velocity and periodically propel and brake the hoop to constrain it to roll at the same velocity as the operator.

9. A hoop in accordance with claim 8 wherein the hoop is formed as a plurality of interchangeable segments adapted to be assembled to provide hoops of various sizes and various planar shapes.

10. A hoop in accordance with claim 9 wherein the hoop material is thermoplastic tubing.

* * * * *